US009735502B2

(12) United States Patent
Stevens et al.

(10) Patent No.: US 9,735,502 B2
(45) Date of Patent: Aug. 15, 2017

(54) CONNECTOR WITH A RETAINER ASSEMBLY

(71) Applicant: Hewlett-Packard Development Company, L.P., Houston, TX (US)

(72) Inventors: Matthew E Stevens, Houston, TX (US); Chris F Felcman, Magnolia, TX (US)

(73) Assignee: Hewlett Packard Enterprise Development LP, Houston, TX (US)

( * ) Notice: Subject to any disclaimer, the term of this patent is extended or adjusted under 35 U.S.C. 154(b) by 0 days.

(21) Appl. No.: 15/033,186

(22) PCT Filed: Dec. 13, 2013

(86) PCT No.: PCT/US2013/075122
§ 371 (c)(1),
(2) Date: Apr. 29, 2016

(87) PCT Pub. No.: WO2016/144285
PCT Pub. Date: Sep. 15, 2016

(65) Prior Publication Data

US 2016/0365671 A1 Dec. 15, 2016

(51) Int. Cl.
*H01R 13/621* (2006.01)
*H01R 13/639* (2006.01)
(Continued)

(52) U.S. Cl.
CPC ..... *H01R 13/621* (2013.01); *H01R 13/6395* (2013.01); *H01R 24/76* (2013.01);
(Continued)

(58) Field of Classification Search
CPC ..... H01R 13/62933; H01R 13/639
See application file for complete search history.

(56) References Cited

U.S. PATENT DOCUMENTS 5,288,241 A 2/1994 Davidge et al.
5,538,437 A 7/1996 Bates et al.
(Continued)

FOREIGN PATENT DOCUMENTS

EP 0594937 5/1994
EP 2639895 9/2013
(Continued)

OTHER PUBLICATIONS

Unique IEC Lock Power Leads, Retrieved from the internet Dec. 13, 2013, http://www.comms-express.com/products/iec-look-c13-female-iec-c14-male-lead/ >.

*Primary Examiner* — James Harvey
*Assistant Examiner* — Oscar C Jimenez
(74) *Attorney, Agent, or Firm* — International IP Law Group, PLLC

(57) ABSTRACT

Example implementations relate to a connector with a retainer assembly. For example, an apparatus may include a connector having a housing and a retainer assembly to retain a power plug within the housing. The retainer assembly may retain a first type of power plug within the housing with a first retaining feature using a locking fit and retain a second type of power plug within the housing with a second retaining feature using a friction it.

15 Claims, 5 Drawing Sheets

(51) Int. Cl.
*H01R 24/76* (2011.01)
*H01R 24/78* (2011.01)
*H01R 27/00* (2006.01)
*H01R 103/00* (2006.01)

(52) U.S. Cl.
CPC ..... *H01R 24/78* (2013.01); *H01R 27/00* (2013.01); *H01R 2103/00* (2013.01)

(56) References Cited

U.S. PATENT DOCUMENTS 6,817,871 B2 11/2004 Hedrick et al.
6,979,220 B1 * 12/2005 Ray ..... H01R 13/6392 439/346
7,156,682 B1 1/2007 Lai
9,509,086 B2 * 11/2016 Utz ..... H01R 13/5812
2007/0238348 A1 * 10/2007 Kopelman ..... H01H 37/74 439/452
2011/0256750 A1 * 10/2011 Chen ..... H01R 13/506 439/345
2013/0097812 A1 * 4/2013 Sanders ..... H01R 13/639 24/115 R
2013/0109213 A1 * 5/2013 Chang ..... H01R 24/78 439/304
2013/0157495 A1 * 6/2013 Chang ..... H01R 13/639 439/345
2013/0244468 A1 * 9/2013 Chang ..... H01R 13/6395 439/345
2015/0044900 A1 * 2/2015 Mcdowall ..... H01R 13/6395 439/372
2015/0357758 A1 * 12/2015 Krietzman ..... H01R 13/6392 439/345

FOREIGN PATENT DOCUMENTS

KR 100977381 8/2010
WO WO 2013/135780 A1 9/2013

* cited by examiner

CONNECTOR WITH A RETAINER ASSEMBLY

BACKGROUND

An external power source, such as an electrical outlet may provide power to a computing device, such as a laptop computer, a tablet computer, or a smartphone. A power plug, of the external power source may be plugged into a connector of the computing device so that power may be provided to the computing device.

BRIEF DESCRIPTION OF THE DRAWINGS

Some examples of the present application are described with respect to the following figures.

DETAILED DESCRIPTION

Figure 1:
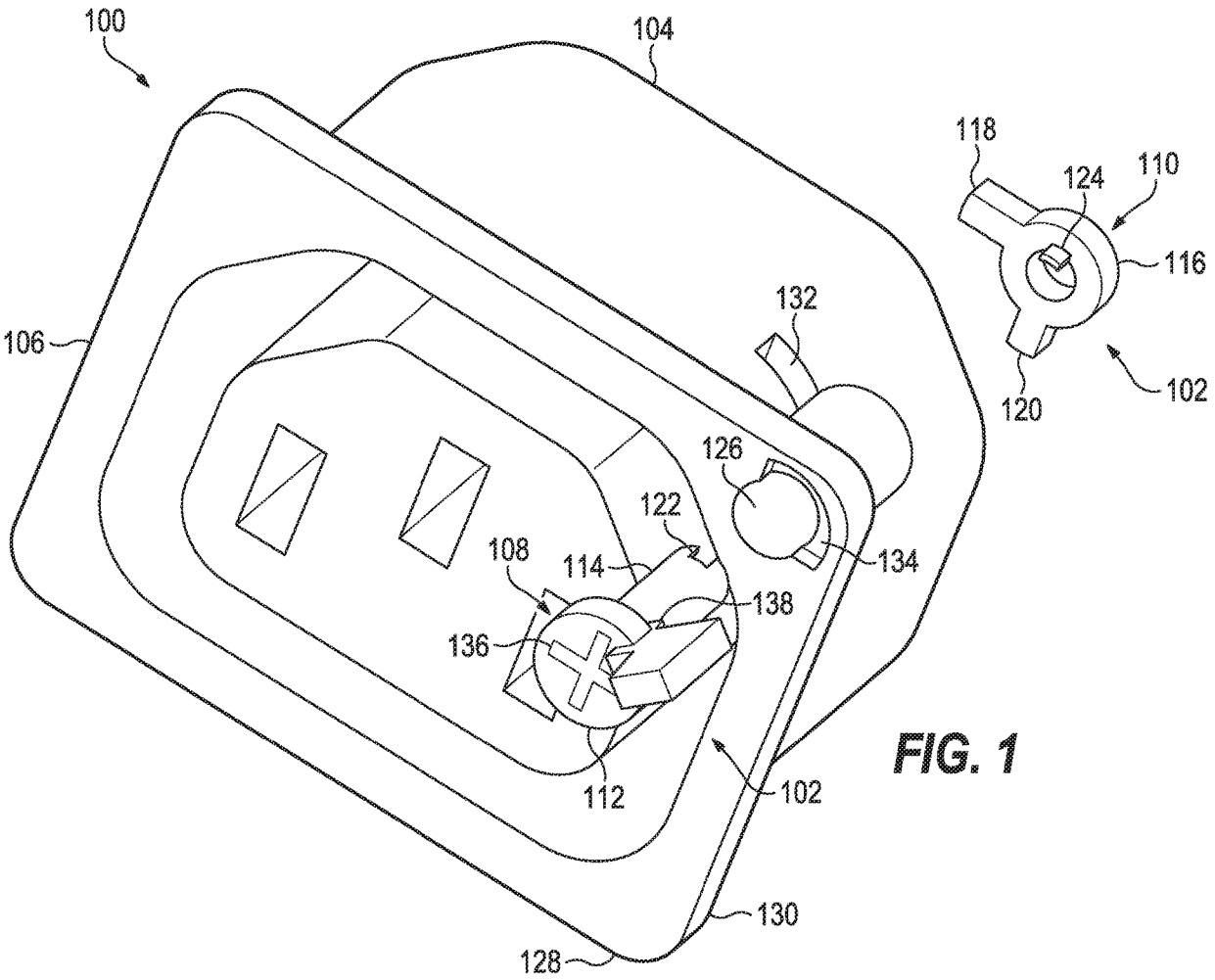
FIG. 1 illustrates an example of a connector including a retainer assembly to retain a power plug within a housing of the connector.

As described above, a power plug of an external power source may be plugged into a connector of a computing device to provide power to the computing device. For a computing device that is powered by electricity up to 250 volts, a plurality of power plugs compliant with the international Electrotechnical Commission (IEC) 60320 standard may be used to provide power to the computing device via corresponding connectors. For example, under the IEC 60320 standard, a C14 power plug may be used to provide power to a computing device via a C13 connector. As another example, a C20 power plug may be used to provide power to a computing device via a C19 connector.

When a power plug, such as a C14 power plug, is plugged into to a connector, such as a C13 connector, electricity may flow from a power source to a computing device. However, the power plug may be unplugged from the connector inadvertently. For example, the power plug may be unplugged from the connector due to loose coupling between the power plug and the connector. As another example, the power plug may be unplugged from the connector due to external interference, such as when a person runs into the power plug and/or the connector thereby uncoupling the power plug from the connector. When the power plug, is inadvertently unplugged from the connector, the computing device may shut down due to loss of power and unsaved data on the computing device may be lost.

Accordingly, examples described herein address the above challenges of a power plug inadvertently unplugged from a connector by providing a connector including a retaining assembly to retain multiple types of power plugs within a housing of the connector. For example, a connector may include a retainer assembly having a retaining member. The retaining member may include a first retaining feature and a second retaining feature. The first retaining feature may provide a locking fit to retain a first type of power plug within a housing of the connector. The second retaining feature may provide a friction fit to retain a second type of power plug within the housing of the connector. In this manner, examples described herein may reduce a likelihood of a power plug inadvertently unplugging from a connector including a retainer assembly, such as due to an external force or due to loose coupling of the power plug and the connector, as compared to a connector without a retainer assembly. In addition, one connector may be used to achieve better retention of the power plug within the housing for multiple different types of power plugs.

In one example, an apparatus includes a connector having a housing. The apparatus also includes a retainer assembly to retain a power plug within the housing. The retainer assembly includes a first retaining member and a second retaining member. The second retaining member is movable via the first retaining member. The second retaining member to retain a first type of power plug within the housing via a first retaining feature of the second retaining member and to retain a second type of power plug within the housing via a second retaining feature of the second retaining member. The first retaining feature to provide a locking fit. The second retaining feature to provide a friction fit.

In another example, an apparatus includes a connector having as housing. The apparatus also includes a retainer assembly to retain a power plug within the housing. The retainer assembly includes a first retaining member and a second retaining member. The second retaining member is movable via the first retaining member. The second retaining member to retain a first type of power plug within the housing via a first retaining feature of the second retaining member and to retain a second type of power plug within the housing via a second retaining feature of the second retaining member. The first retaining feature to provide a locking fit. The first retaining feature is receivable in a slot of a housing of the first type of power plug. The second retaining feature to provide a friction fit. The second retaining member is in physical contact with an outer surface of the second type of power plug.

In another example, a method includes retaining a first type of power plug within a housing of a connector via a first retaining feature of a second retaining member of a retaining assembly. The first retaining feature provides a locking fit. The second retaining member is movable via a first retaining member of the retaining assembly. The method also includes retaining a second type of power plug within the housing via a second retaining feature of the retaining member. The second retaining feature provides a friction fit.

Referring now to the figures, FIG. 1 is an example of a connector 100 including a retainer assembly 102 to retain a power plug within a housing 104 of the connector 100. Connector 100 may be any type of inlet receptacle that is used to couple to a corresponding power plug. For example, connector 100 may be an inlet receptacle that is compliant with the International Electrotechnical Commission (IEC) 60320 standard, such as a C13 connector, a C15 connector, a C17 connector, a C19 connector, a C21 connector, or a combination thereof. Housing 104 may be any type of casing of an inlet receptacle. Housing 104 may include as flange 106. Flange 106 may be a rim of housing 104. Housing 104 and retainer assembly 102 may be formed using a variety of material, such as molded plastic.

Retainer assembly 102 may include a first retaining member 108 and a second retaining member 110. First retaining member 108 may be a first part of retaining assembly 102 that provides a rotating mechanism for retainer assembly 102. Second retaining member 110 may be a second part of retaining assembly 102 that provides a mechanism to retain a power plug within housing 104. Retainer assembly 102 may be any type of mechanism to keep a power plug within housing 104. First retaining member 108 may include a head portion 112 and a body portion 114. Head portion 112 may be a first part of first retaining member 108 that is not in direct contact with second retaining member 110. Body portion 114 may be a second part of second retaining member 110 that is in direct contact with second retaining member 110.

Second retaining member 110 may include a body portion 116, a first retaining feature 118, and a second retaining feature 120. Body portion 116 may be a part of second retaining member 110 that is in direct contact with first retaining member 108. Retaining features 118 and 120 may be any design features used to increase an amount of force needed to remove a power plug from connector 100. For example, first retaining feature 118 may be a first retaining tab extending from body portion 114 and second retaining feature 120 may be a second retaining tab extending from body portion 114. The first retaining tab and the second retaining tab may have a variety of shapes, such as rectangle or triangle. The first retaining tab may have a greater length than the second retaining tab.

First retaining member 108 may be coupled to second retaining member 110 via a mating feature 122 of first retaining member 108 and a mating feature 124 of second retaining member 110. Mating feature 122 may be located on body portion 114 of first retaining member 108 and mating feature 124 may be located on body portion 116 of second retaining member 110. Body portion 114 may be inserted through a cavity 126 of flange 106 so that mating feature 122 may be coupled to mating feature 124. Cavity 126 may be an opening or a tunnel. Mating features 122 and 124 may be any design features that enable two parts to be coupled together. For example, mating feature 122 may be a recess and mating feature 124 may be a protrusion that is receivable in the recess. In some examples, first retaining member 108 may be coupled to second retaining member 110 via adhesive.

When coupled, head portion 112 of first retaining member 108 may be located adjacent to a proximal end 128 of flange 106 and second retaining member may be located adjacent to a distal end 130 of flange 106. Although FIG. 1 illustrates first retaining member 108 and second retaining member 110 as distinct parts, it should be understood that first retaining member 108 and second retaining member 110 may be formed as a single part. For example, first retaining member 108 and second retaining, member 110 may be formed as a single part using a plastic molding process.

During operation, second retaining member 110 may retain a power plug within housing 104 using first retaining feature 118 and/or second retaining feature 120 based on the type of the power plug. For example, when a first type of power plug is plugged into connector 100, retainer assembly 102 may be moved or rotated from a first orientation to a second orientation via movement of first retaining member 108 to retain the first type of power plug via first retaining feature 118. Because second retaining member 110 is coupled to first retaining member 108, first retaining member 108 and second retaining member 110 may move synchronously. First retaining feature 118 may be receivable in a slot 132 of housing 104. First retaining feature 118 may provide a locking fit to retain the first type of power plug within housing 104. As used herein, a locking fit may be a mechanism to secure the first type of power plug within housing 104 such that the first type of power plug is substantially immovable. For example, first retaining feature 118 may provide a locking fit to prevent removal of the first type of power plug such that removing the power plug from housing 104 causes physical damage or deformation to the power plug and/or first retaining feature 118. The first type of power plug is described in more detail with reference to FIG. 2.

When a second type of power plug is plugged into connector 100, retainer assembly 102 may be moved from the first orientation or the second orientation to a third orientation via movement of first retaining member 108 to retain the second type of power plug via second retaining feature 120. Second retaining feature 120 may be receivable in slot 132. Second retaining feature 120 may provide a friction fit to retain the second type of power plug within housing 104. As used herein, a friction fit may be a mechanism to apply an external force to the second type of power plug such that an amount of force needed to remove the second type of power plug from housing 104 is increased as compared to an amount of force needed to remove the second type of power plug from housing 104 when the external force is not applied to the second type of power plug. The second type of power plug is described in more detail with reference to FIG. 2.

In some examples, rotations of retainer assembly 102 may be limited so that a user may not cause damage to first retaining feature 118 and/or second retaining feature 120 by over rotating retainer assembly 102. For example, partial sidewalls of cavity 126 may be removed to form a groove 134. A protrusion 138 may extend from head portion 112 of first retaining member 108 such that protrusion 138 may limit rotations of retainer assembly 102 to the length of groove 134.

In some examples, a pattern 136 may be formed in bead portion 112 of first retaining member 108 so that first retaining member 108 may be rotated using an external tool, such as a screw driver. In other examples, head portion 112 may include a rotation tab 138 so that a user may rotate first retaining member 108 by grabbing the rotation tab 138 with the user's fingers. In other examples, flange 106 may include markings (not shown in FIG. 1) to indicate directions of rotations to deploy first retaining feature 118 and/or second retaining, feature 120.

Figure 2:
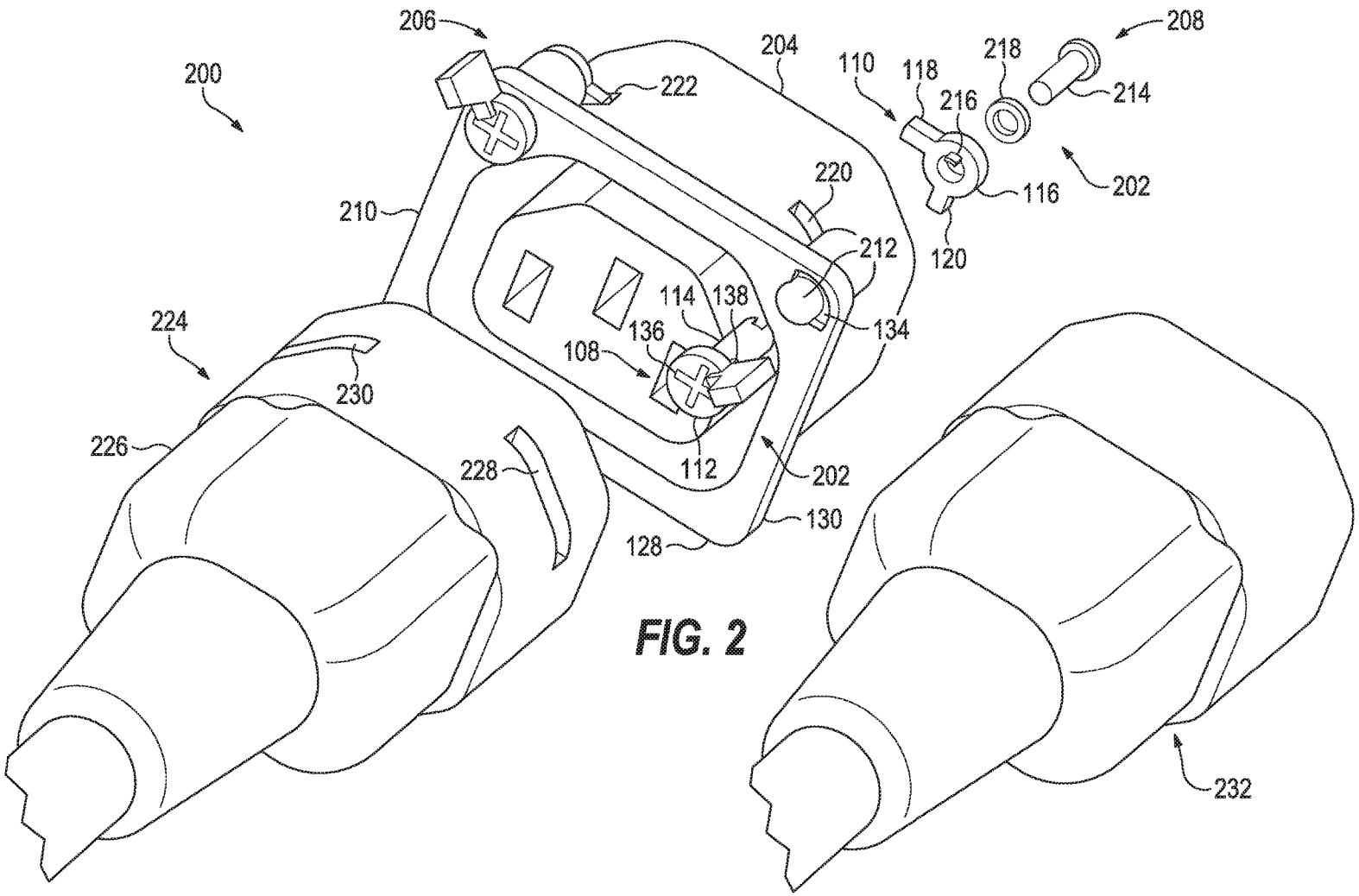
FIG. 2 illustrates another example of a connector including a retainer assembly to retain a power plug within a housing of the connector.

FIG. 2 illustrates another example of a connector 200 including a retainer assembly 202 to retain a power plug within a housing 204 of the connector 200. Connector 200 may be similar to connector 100 of FIG. 1. However, connector 200 may include a plurality of retainer assemblies instead of a single retainer assembly. For example, connector 200 may include retainer assembly 202 and a retainer assembly 206. Retainer assembly 202 may include first retaining member 108, second retaining member 110, and a third retaining member 208. Retainer assembly 206 may be similar to retainer assembly 202. For purpose of brevity and clarity, description of retainer assembly 206 is omitted. Although two retainer assemblies are described in FIG. 2, it should be understood that connector 200 may include other numbers of retainer assemblies.

Housing 204 may include a flange 210, a first cavity 212, and a second cavity (not shown in FIG. 2). The second cavity may be similar to first cavity 212. Body portion 114 of lint retaining member 108 may be receivable in first cavity 212 to couple first retaining member 108 to second retaining member 110. A body portion 214 of third retaining member 208 may be receivable in a cavity 216 of second retaining member 110 and in a central bore (not shown in FIG. 2) of first retaining member 108 to provide a support mechanism to couple first retaining member 108 to second retaining member 110. In some examples, a washer 218 may also be used as part of the support mechanism. Retaining members of retainer assembly 206 may be similarly coupled as the second cavity. Housing 204 may also include slots 220 and 222 that are similar to slot 132 of FIG. 1.

Similar to connector 100 connector 200 may retain different types of power plugs within housing 204 using retaining features of retainer assemblies 202 and 206. For example, connector 200 may retain a first type of power plug 224 and a second type of power plug 232. Power plugs 224 and 232 may be any types of power plug that is compatible with connector 200. For example, power plugs 224 and 232 may be a power plug that is compliant with the IEC 60320 standard, such as a C14 power plug, a C16 power plug, a C18 power plug, a C20 power plug, or a C22 power plug.

First type of power plug 224 may include a housing 226. Housing 226 may include slots 228 and 230. When first type of power plug 224 to housing 204. Slots 228 and 230 may align with slots 220 and 222 respectively. First retaining feature 118 may be receivable in slots 220 and 228 and a corresponding retaining feature of retainer assembly 206 may be receivable in slots 222 and 230 to retain first type of power plug 224 within housing 204 via a locking fit. Using a locking fit to retain first type of power plug 224 within housing 204 is described in more detail with reference to FIGS. 3A-3B.

Second type of power plug 232 may be similar to first type of power plug 224. However, unlike first type of power plug, second type of power plug 232 may not include slots 228 and/or 230. When second type of power plug is plugged into housing 204. Second retaining feature 120 and a corresponding retaining, feature of retainer assembly 206 may be receivable in slots 220 and 222 respectively to retain second type of power plug 232 within housing 204 via a friction fit. Using a friction fit to retain second type of power plug 232 within housing 204 is described in more detail with reference to FIGS. 3A and 3C.

Figure 3A:
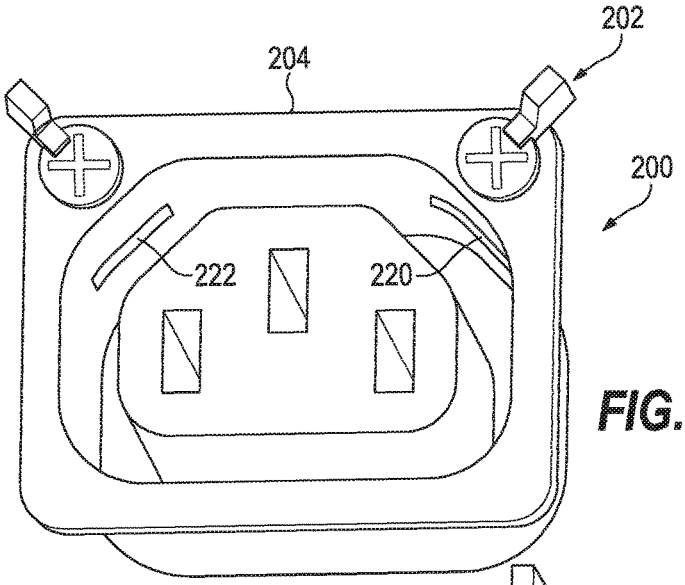
FIG. 3A illustrates an example of the connector of FIG. 2 prior to being plugged in by a power plug.

FIG. 3A is an example of the connector of FIG. 2 prior to being plugged in by a power plug, such as first type of power plug 224 or second type of power plug 232. Retainer assembly 202 may be in a first orientation such that first retaining feature 118 and second retaining feature 120 may not extend beyond slots 220 and 222, respectively. The power plug may then be plugged into housing 204.

Figure 3B:
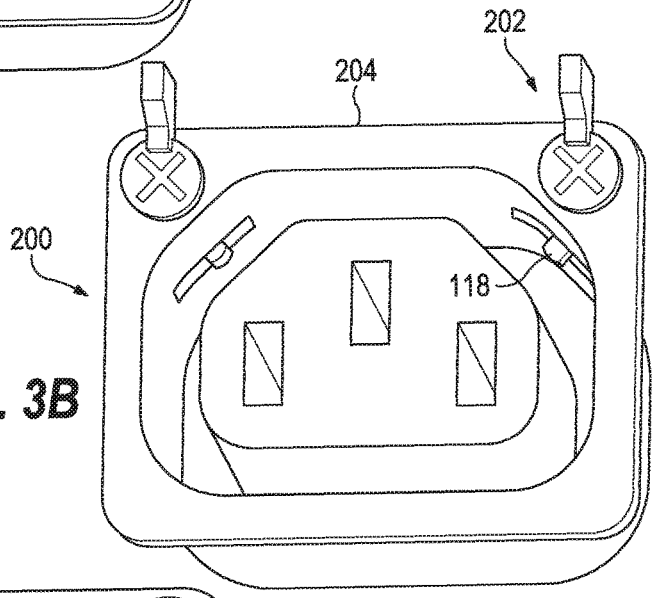
FIG. 3B illustrates an example of the connector of FIG. 2 retaining a first type of power plug via a first retaining feature.

FIG. 3B is an example of the connector 200 of FIG. 2 retaining first type of power plug 224 via first retaining feature 118. When first type of power plug 224 is plugged into connector 204, retainer assembly 202 may move from the first orientation of FIG. 3A to a second orientation such that first retaining feature 118 may extend beyond slot 220 and into slot 228 to retain first type of power plug 224 via a locking fit. When first type of power plug 224 is retained via the locking fit, removal of first type of power plug 224 from housing 204 without returning retainer assembly 202 to the first orientation may physically damage and/or deform first retaining feature 118.

Figure 3C:
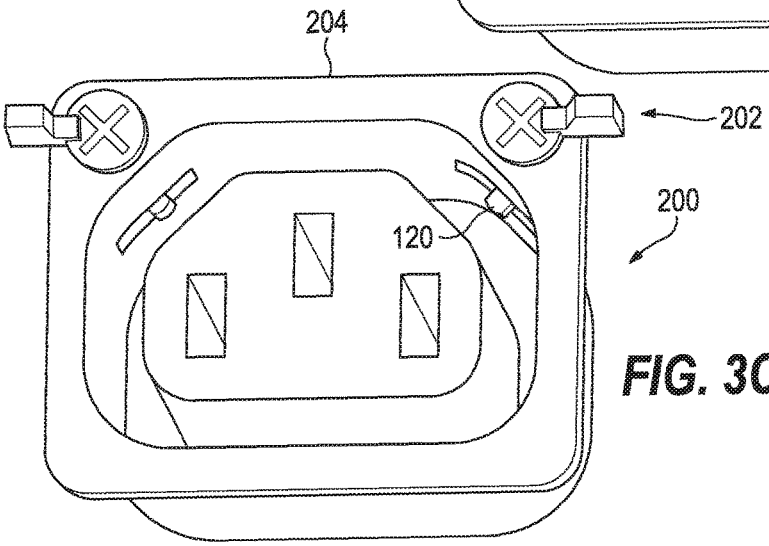
FIG. 3C illustrates an example of the connector of FIG. 2 retaining a second type of power plug via a second retaining feature.

FIG. 3C is an example of the connector 200 of FIG. 2 retaining second type of power plug 232 via second retaining feature 120. When second type of power plug 232 is plugged into connector 200, retainer assembly 202 may move from the first orientation of FIG. 3A or the second orientation of FIG. 3B to a third orientation such that second retaining feature 120 may extend beyond slot 220. Second retaining feature 120 may be in physical contact with an outer surface of second type of power plug 232 to retain second type of power plug 232 within housing 204 via a friction fit. For example, second retaining feature 120 may have a particular length such that when second retaining feature 120 is in physical contact with the outer surface of second type of power plug 232, second retaining feature 120 may apply a downward force to second type of power plug 232. The friction fit may increase an amount of three needed to remove second type of power plug 232 from housing 204 while retainer assembly 202 is in the third orientation as compared to an amount of force needed to remove second type of power plug 232 from a housing of a connector without retainer assembly 202.

Figure 4:
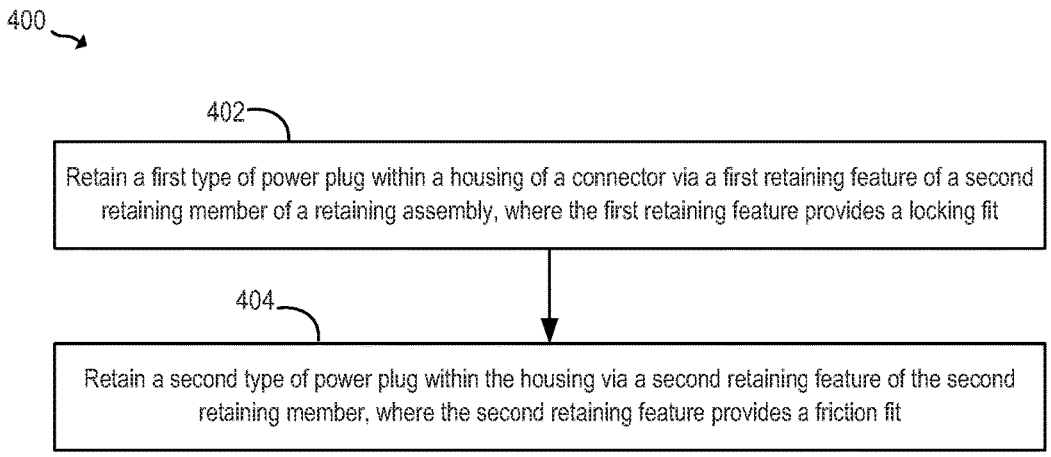
FIG. 4 is an example of a flowchart illustrating an example method of retaining a power plug within a housing of a connector including a retainer assembly.

FIG. 4 is an example of a flowchart illustrating a method 400 of retaining a power plug within a housing of a connector including a retainer assembly. Method 400 may be implemented using connector 100 of FIG. 1 and/or connector 200 of FIG. 2. Method 400 includes, at 402, retaining a first type of power plug within a housing of a connector via a first retaining feature of a second retaining member of a retaining assembly, where the first retaining feature provides a locking fit. For example, first retaining feature 118 may retain first type of power plug 224 within housing 204 via a locking fit. Method 400 also includes, at 404, retaining a second type of power plug within the housing via a second retaining feature of the second retaining member, where the second retaining feature provides a friction fit. For example, second retaining feature 120 may retain second type of power plug 232 within housing 204 via a friction fit.

Figure 5:
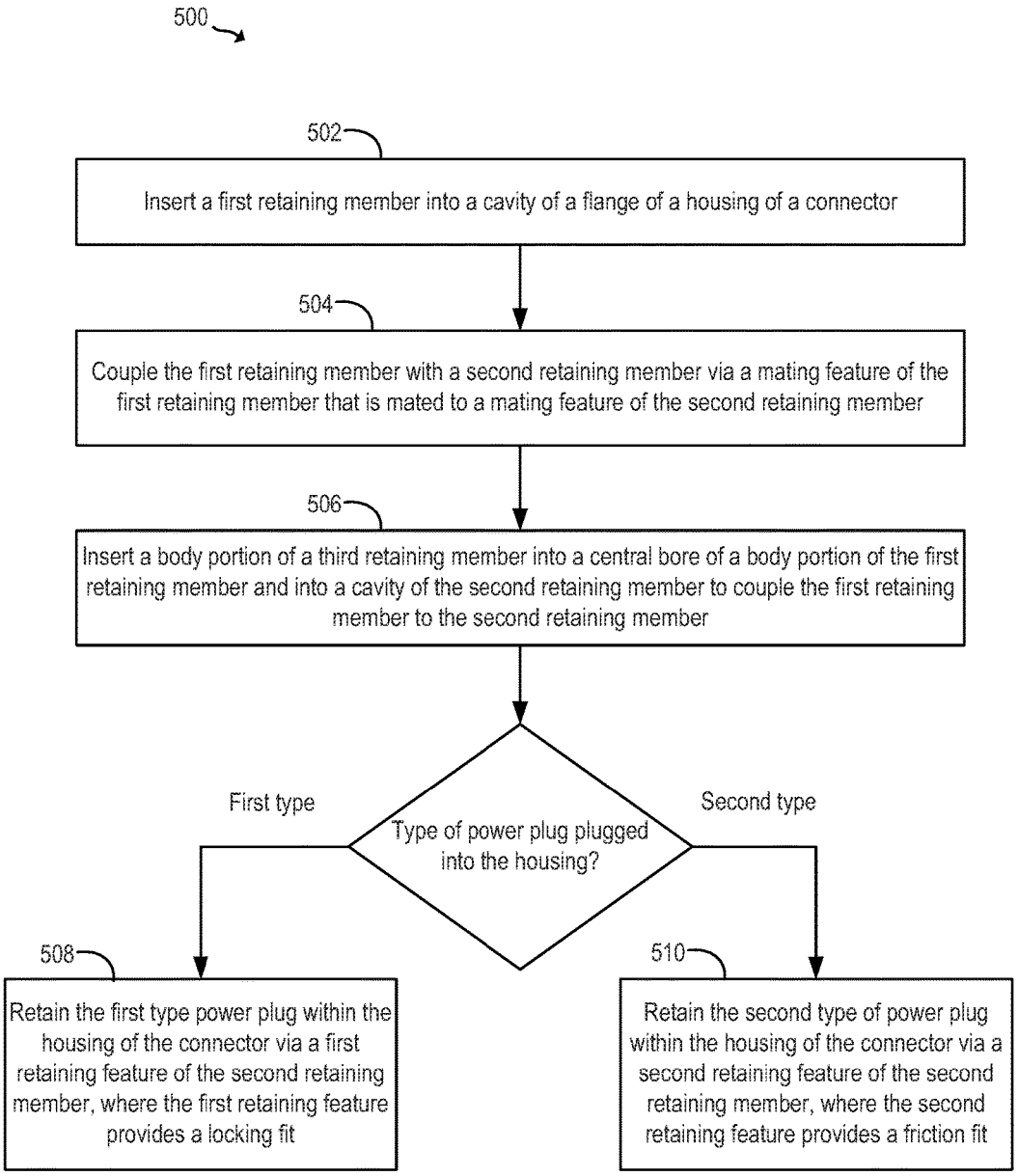
FIG. 5 is another example of a flowchart illustrating an example method of retaining a power plug within a housing of a connector including a retainer assembly.

FIG. 5 is another example of a flowchart illustrating a method 500 of retaining a power plug within a housing of a connector including a retainer assembly. Method 500 includes inserting a first retaining member into a cavity of a flange of a housing of a connector, at 502. For example, body portion 114 of first retaining member 108 may be inserted through a cavity 126 of flange 106 so that mating feature 122 of first retaining member 108 may be coupled with mating feature 124 of second retaining member 110.

Method 500 also includes coupling the first retaining member with a second retaining member via a mating feature of the first retaining member that is mated to a mating feature of the second retaining member, at 504. For example, first retaining member 108 may be coupled to second retaining member 110 via a mating feature 122 of first retaining member 108 and a mating feature 124 of second retaining member 110.

Method 500 further includes inserting a body portion of a third retaining member into a central bore of a body portion of the first retaining member and into a cavity of the second retaining member to couple the first retaining member to the second retaining member, at 506. For example, a body portion 214 of third retaining member 208 may be receivable in a cavity 216 of second retaining member 110 and in a central bore (not shown in FIG. 2) of first retaining member 108 to provide a support mechanism to couple first retaining member 108 to second retaining member 110.

Method 500 further includes, at 508, when a first type of power plug is plugged into the housing of the connector, retaining the first type power plug within the housing of the connector via a first retaining feature of the second retaining member, where the first retaining feature provides a locking fit. For example, when a first type of power plug is plugged into connector 100, retainer assembly 102 may be moved or rotated from a first orientation to a second orientation via movement of first retaining member 108 to retain the first type of power plug via a locking fit provided by first retaining feature 118.

Method 500 further includes, at 510, when a second type of power plug is plugged into the housing of the connector, retaining the second type power plug within the housing of the connector via a second retaining feature of the second retaining member, where the second retaining feature provides a friction fit. For example, when a second type of power plug is plugged into connector 100, retainer assembly 102 may be moved from the first orientation or the second orientation to a third orientation via movement of first retaining member 108 to retain the second type of power plug via a friction fit provided by second retaining feature 120.

What is claimed is:

1. An apparatus comprising:

a connector having a housing; and a retainer assembly having a first orientation before a power plug is plugged into the housing, the retainer assembly to retain the power plug within the housing when the power plug is plugged into the housing, wherein the retainer assembly includes:

a first retaining member; and a second retaining member movable via the first retaining member to three positions, the three positions being disengaged, a locking fit, and a friction fit, the second retaining member to:

retain a first type of power plug within the housing via a first retaining feature of the second retaining member, the first retaining feature to provide the locking fit, wherein the retainer assembly has a second orientation when the first type of power plug is retained within the housing; and retain a second type of power plug within the housing via a second retaining feature of the second retaining member, the second retaining feature to provide the friction fit wherein the retainer assembly has a third orientation when the second type of power plug is retained within the housing.

2. The apparatus of claim 1, wherein the retainer assembly further includes:

a third retaining member to couple the first retaining member to the second retaining member, wherein a body portion of the third retaining member is receivable in a cavity of the second retaining member and in a central bore of a body portion of the first retaining member.

3. The apparatus of claim 1, wherein the first retaining feature includes a first retaining tab, wherein the second retaining feature includes a second retaining tab, and wherein the first retaining tab has a greater length than the second retaining tab.

4. The apparatus of claim 1, wherein the first retaining feature is receivable in a slot of a housing of the first type of power plug, and wherein the first retaining feature is receivable in a slot of the housing of the connector.

5. The apparatus of claim 1, wherein the second retaining feature is receivable in a slot of the housing of the connector, and wherein the second retaining feature is to make physical contact with an outer surface of the second type of power plug.

6. The apparatus of claim 1, wherein the first retaining member is coupled to the second retaining member via a mating feature of the first retaining member and via a mating feature of the second retaining member, wherein the mating feature of the first retaining member includes a recess, and wherein the mating feature of the second retaining member includes a protrusion receivable in the recess.

7. The apparatus of claim 1, further comprising:

a second retainer assembly comprising:

a third retaining member; and a fourth retaining member movable via the third retaining member, the fourth retaining member to:

retain the first type of power plug within the housing of the connector via a third retaining feature of the third retaining member, wherein the third retaining feature is to provide the locking fit; and retain the second type of power plug within the housing of the connector via a fourth retaining feature of the fourth retaining member, wherein the fourth retaining feature is to provide the friction fit.

8. The apparatus of claim 1, wherein the housing of the connector includes a flange, wherein the first retaining member is adjacent to a proximal end of the flange, and wherein the second retaining member is adjacent to a distal end of the flange.

9. A method comprising:

maintaining a first orientation of a retaining assembly before a power plug is plugged into a housing;

moving a second retaining member via a first retaining member to three positions, the three positions being disengaged, a locking fit, and a friction fit;

retaining a first type of power plug within the housing of a connector via a first retaining feature of the second retaining member of the retaining assembly, wherein the first retaining feature provides the locking fit, and wherein the retaining assembly has a second orientation when the first type of power plug is retained within the housing; and retaining a second type of power plug within the housing via a second retaining feature of the second retaining member, wherein the second retaining feature provides the friction fit, and wherein the retaining assembly has a third orientation when the second type of power plug is retained within the housing.

10. The method of claim 9, wherein the connector includes a body portion of a third retaining member inserted into a central bore of a body portion of the first retaining member and into a cavity of the second retaining member to couple the first retaining member to the second retaining member.

11. The method of claim 9, wherein the first retaining feature is receivable in a slot of a housing of the first type of power plug, and wherein the first retaining feature is receivable in a slot of the housing of the connector.

12. The method of claim 9, wherein the second retaining feature is receivable in a slot of the housing of the connector, and wherein the second retaining feature is in physical contact with an outer surface of the second type of power plug.

13. An apparatus comprising:

a connector having a housing; and a retainer assembly having a first orientation before a power plug is plugged into the housing, the retainer assembly to retain the power plug within the housing when the power plug is plugged into the housing, wherein the retainer assembly includes:

a first retaining member; and a second retaining member movable via the first retaining member to three positions, the three positions being disengaged, a locking fit, and a friction fit, the second retaining member to:

retain a first type of power plug within the housing via a first retaining feature of the second retaining member, the first retaining feature to provide the locking fit, wherein the retainer assembly has a second orientation when the first type of power plug is retained within the housing, and wherein the first retaining feature is receivable in a slot of a housing of the first type of power plug; and retain a second type of power plug within the housing via a second retaining feature of the second retaining member, the second retaining feature to provide the friction fit, wherein the retainer assembly has a third orientation when the second type of power plug is retained within the housing, and wherein the second retaining feature is to contact an outer surface of the second type of power plug.

14. The apparatus of claim 13, wherein the retainer assembly further includes a third retaining member to couple the first retaining member to the second retaining member, wherein a body portion of the third retaining member is receivable in a cavity of the second retaining member and in a central bore of a body portion of the first retaining member.

15. The apparatus of claim 13, wherein the housing of the connector includes a flange, wherein the first retaining member is adjacent to a proximal end of the flange, and wherein the second retaining member is adjacent to a distal end of the flange.

* * * * *